United States Patent [19]

Enchev et al.

[11] Patent Number: 4,966,624

[45] Date of Patent: Oct. 30, 1990

[54] METHOD AND APPARATUS FOR ELECTRIC REFINING OF LEAD

[75] Inventors: Ivan D. Enchev; Lyuben R. Starev; Elieser P. Illel; Georgi N. Korudanov, all of Plovdiv, Bulgaria

[73] Assignee: Institute Po Tzvetna Metalurgia, Plovdiv, Bulgaria

[21] Appl. No.: 403,700

[22] Filed: Sep. 6, 1989

[51] Int. Cl.[5] ..... C22B 4/00

[52] U.S. Cl. ..... 75/10.65; 75/10.1; 75/10.62; 75/77; 373/104; 373/109

[58] Field of Search ..... 75/10.1, 10.65, 10.62, 75/77; 420/590; 373/104, 109

[56] References Cited

U.S. PATENT DOCUMENTS 1,333,720 3/1920 Johnson ..... 75/10.62

4,162,915 7/1979 Maes ..... 75/10.62

*Primary Examiner*—Peter D. Rosenberg

*Attorney, Agent, or Firm*—Klein & Vibber

[57] ABSTRACT

A method for electric refining of lead with alternating current in which the basic stage of the process is preceded by two stages, a preparatory stage and an initial stage. The preparatory stage involves pretreatment of the electrode surfaces by means of alternating current of equal width and amplitude of the forward and reverse pulses. During the initial stage there is effected an electric refining with alternating current having reduced current density.

A circuit for electric refining of lead with alternating current has two controllable current rectifiers, each of which is connected to a separate group of electrolytic baths. The groups of electrolytic baths and the controllable current rectifiers are connected in series and opposite to one another. In parallel with the output busbars of each controllable current rectifier there is connected in the same direction a semicontrollable thyristor switch and between the common point of the groups of electrolytic baths and the common point of the controllable current rectifiers there is connected in its conductive direction a common semicontrollable thyristor switch.

2 Claims, 1 Drawing Sheet

METHOD AND APPARATUS FOR ELECTRIC REFINING OF LEAD

FIELD OF THE INVENTION

This invention relates to a method and a circuit for electric refining of lead which can be used in metallurgy.

BACKGROUND OF THE INVENTION

A known method for refining lead by electrolysis is disclosed in Thomas et al, Lead Electrorefining at Cominco, TMS-AIME Paper No. A81-8, 1980. This known method uses a direct current having a density of 200 A/m$^2$, lead anodes with maximum concentration of the basis admixtures $C_{Sb}<1.2\%$, $C_{As}\leqq 0.6\%$, $C_{Bi}\leqq 0.5\%$, $C_{Cu}\leqq 0.02\%$, $C_{Ag}\leqq 0.2\%$, silicon fluorine hydrogen, boron fluorine hydrogen or sulfoamine electrolyte with different additives, at a temperature of 313–318 degrees K and a rate of circulation corresponding to 0.5–1.5 exchanges of the bath content per hour. The cycle of replacement of the electrodes reaches 120–240 hours.

A drawback of this method is that the increase of the current density results in changes in the structure of the electrode surfaces contributing to the formation of dendrites and metal short circuits which could spoil the process. The increase of the anode superpotential above 250 mV results in a decrease in the quality of the refined metal. The initial start is related to a transition period for stabilizing the process, the duration of which is 2 to 4 weeks, and during this period the quality of the refined metal is not ensured.

There is another known method for electric refining of lead disclosed in Bulgarian Inventor's Certificate No. 9405. This known method uses alternating current, making possible the use of increased current densities (100 to 500 A/m$^2$), and is featured by a duration of the time of passing of reverse current being 2 to 8% of the alternation period, with a pulse duration of 7 to 30 seconds, the intensities of the forward and the reverse current being equal.

A drawback of this known method is the unsatisfactory structure of the metal which is formed on the surface of the cathode matrix under the influence of the increased current density during the initial stage of the process. This predetermines an increased number of nonmetal short circuits in the later stages of the process, resulting in a reduced current efficiency, increased relative power consumption and reduction of the quality of the refined metal. The relatively high density of the reverse current results in its action not only on the active centres of crystallization, but also on separate massive microsectors and contributes to an additional reduction of the current efficiency.

A known circuit for current supply in alternating current electric refining of lead is disclosed in Bulgarian Inventor's Certificate No. 20703. This known current supply circuit comprises two controllable current rectifiers which are connected in series with their DC output busbars and are switched alternatively to the load.

The drawback of this known current supply circuit is that, at any given moment only one of the current rectifiers is switched on. Thus, their total power is not fully utilized.

Another known circuit for current supply in electric extraction of metals with alternating current is disclosed in Bulgarian Inventor's Certificate No. 20702. This known current supply circuit comprises two controllable current rectifiers, each of them being connected to a separate group of electrolyte baths. The groups of electrolyte baths and the controllable current rectifiers are connected in series and opposite to themselves. Parallely to the output of each current rectifier there is connected in its conductive direction a semicontrollable thyristor switch, and between the common points of connection of the bath groups and the current rectifiers there is connected a diode switch.

A drawback of this known circuit is it cannot be used for the supply of alternating current to a circuit for electric refining of lead since the low value of the proper electromotive voltage of the latter is insufficient for the blocking of the diode switch in reversing.

INCORPORATION BY REFERENCE

To the extent necessary and permissible by law, the complete disclosure of each of the above references is incorporated herein by reference.

SUMMARY OF THE INVENTION

It is a general object of this invention to develop a method and a respective circuit for electric refining of lead which make possible the refining of anodes with a higher content of admixtures, an increase in current efficiency, the improvement of the quality of the deposited metal and a reduction of the term of initial balancing of the process.

This object is achieved by a method for refining lead with alternating current in which the basic stage of the process is preceded by two stages, i.e. preparatory and initial. The preparatory stage consists in pretreatment of the electrode surfaces by means of alternating current of equal width and amplitude of the forward and reverse pulses. During the initial stage there is effected an electric refining with alternating current with reduced current density, the current density during the initial stage being half that necessary for normal yield of the process, the density of the reverse current being 0.5 to 0.8 of that of the forward current during the same stage, the width of the pulses during the preparatory stage being 5 to 15 seconds and its duration being 600 to 900 seconds, while the duration of the initial stage is 2 to 3 hours.

This object is also achieved by a circuit for electric refining of lead with alternating current containing two controllable current rectifiers, each of which is connected to a separate group of electrolytic baths. The groups of electrolytic baths and the controllable current rectifiers are connected in series and opposite one to another. Parallel with the output busbars of each controllable current rectifier there is connected in the same direction a semicontrollable thyristor switch. Between the common point of the groups of electrolyte baths and the common point of the controllable current rectifiers there is connected in its conductive direction a common semicontrollable thyristor switch.

Moreover, the inventive electric refining of lead is effected with cathode matrices of pure lead (99.99%) of necessary strength and smoothness, cast or rolled, as well as with lead alloys with calcium (up to 0.1%) antimonium (up to 0.5%) or stainless steel and titanium alloys. A strict fixation between the electrodes is maintained by using cathode rods made of copper pipes of calculated cross-section and suitable limiting seats of the side busbars.

The advantages of the method and the circuit of the invention include intensification of the process of electric refining of lead, increase of the current efficiency, reduction of the relative power consumption, reduction of the number of short circuits, the ability to produce high-quality refined metal, increase of the anode superpotential up to 280 mV, the ability to refine anodes of increased content of the admixtures: $C_{Sb} \leqq 1.5\%$, $C_{Bi} \leqq 0.8\%$, $C_{As} \leqq 0.6\%$, $C_{Cu} \leqq 0.08\%$, $C_{Ag} \leqq 0.5\%$ while observing the relations:

$$\frac{C_{Sb} + C_{As}}{C_{Bi}} \geqq 2.5 \text{ and } \frac{C_{Sb} + C_{As}}{C_{Bi} \times C_{Cu}} \geqq 62$$

as well as a 10 to 15 day reduction of the period for balancing the process after its initial start.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENT

Figure 1:
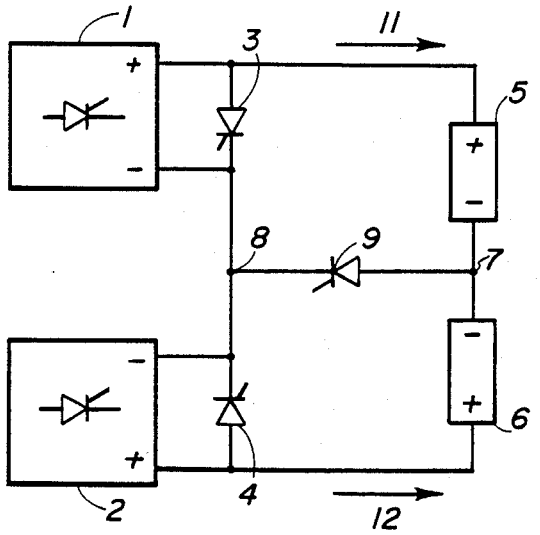
FIG. 1 is a schematic diagram of the circuit for alternating current electric refining of lead.

Referring now to FIG. 1, the circuit of the invention comprises controllable thyristor current rectifiers 1 and 2 and semi-controllable thyristor switches 3 and 4, which are connected in parallel and in the same direction with them.

The current rectifier 1 is connected with its positive pole to the initial anode busbar of a group of baths for electric refining of lead 5, and the current rectifier 2 is similarly connected to the initial anode busbar of another group of baths for electric refining of lead 6. The end cathode busbars of groups 5 and 6 are connected at a common point 7, and the negative poles of the current rectifiers 1 and 2 are connected at a common point 8. Between points 7 and 8 there is connected in its conductive direction a common semicontrollable thyristor switch 9.

Figure 2:
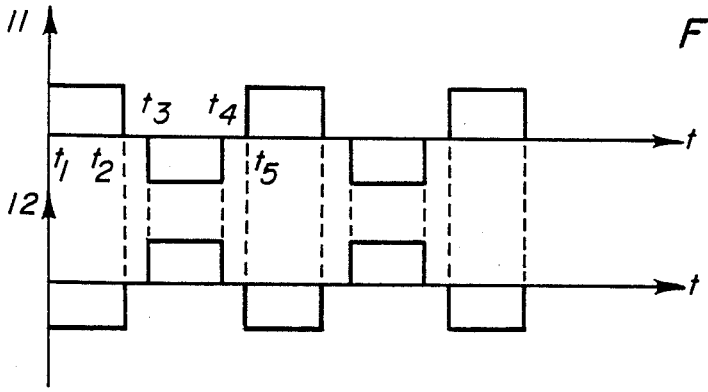
FIG. 2 is a timing diagram illustrating the intensity and the direction of the currents passing during stage I of the process.
Figure 3:
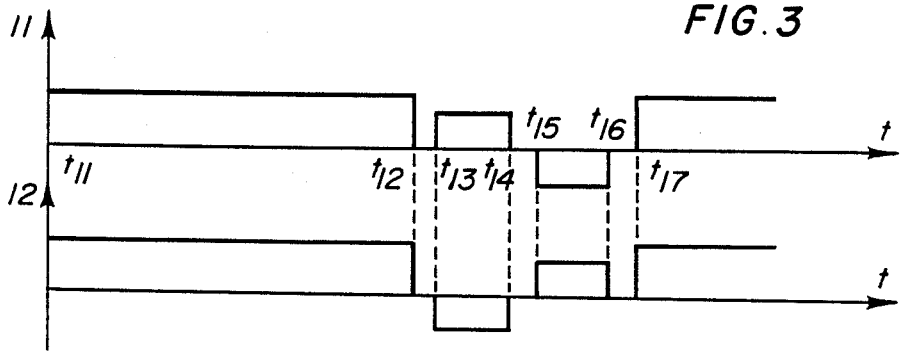
FIG. 3 is a timing diagram illustrating the intensity and the direction of the currents passing during stages II and III of the process.

The method, according to the invention, is best understood by reference to timing diagrams of FIGS. 2 and 3. The top portions of the timing diagrams show current flow through baths 5 and the bottom portions of the timing diagrams show current flow through baths 6. The preparatory stage of the process begins after the charging of the baths in groups 5 and 6 with cathode matrices when switching on the current rectifier 1 and the switch 4. This is indicated in FIG. 2 as point $t_1$.

The passing current 11 is in a normal direction for group 5, while the current 12 is of reverse direction for group 6. At the moment $t_2$, the rectifier 1 is stopped and, thus, the switch 4 is blocked. After a short pause ($t_2$–$t_3$), necessary for attenuation of the transition processes, current rectifier 2 and switch 3 are turned on. This is indicated as $t_3$. The current 11 then flows in the reverse direction for group 5 and the current 12 flows in the normal direction for the bath group 6. This continues until point $t_4$. The interval between points $t_1$–$t_2$ is equal to the interval between points $t_3$–$t_4$. Following point $t_4$, there is another short pause ($t_4$–$t_5$), similar to the pause between $t_2$–$t_3$ and the process is repeated at point $t_5$ in the same manner as $t_1$.

The initial stage of the process of electric refining begins at the moment $t_{11}$, when the current rectifiers 1 and 2 and the common semicontrollable switch 9 are switched on. The currents 11 and 12 both flow in the normal direction for groups 5 and 6, respectively, through which they pass and their intensity is about one half that necessary for the normal yield of the series.

At the moment $t_{12}$, the rectifiers 1 and 2 are switched off, thus blocking also the common switch 9 and, after a short pause, the current rectifier 1 and switch 4 are switched on at point $t_{13}$. From point $t_{13}$ to point $t_{14}$, the current passing through group 5 is in the normal direction while the current passing through group 6 is in the reverse direction. Similarly, during the interval $t_{15}$–$t_{16}$, with switched on current rectifier 2 and switch 3, the current flowing through bath 5 is in the reversed direction while the current flowing through group 6 is in the normal direction.

If the current rectifiers 1 and 2 are correctly dimensioned, the currents flowing during the time interval $t_{13}$–$t_{14}$ will be the same intensity as during the interval $t_{15}$–$t_{16}$ and will have an intensity 0.5 to 0.6 of that of the pulse passed through during the interval $t_{11}$–$t_{12}$, the intensity of which is selected to be about 0.5 of that necessary for the normal yield of the series.

The basic stage of the process is also described by means of FIG. 3 only with the scale changed so that the pulse passed during the interval $t_{11}$–$t_{12}$ has an intensity corresponding to the yield of the series.

The preparatory stage continues 10 to 15 minutes, the width of the bipolar pulses passing through groups 5 and 6 being of from 5 to 15 seconds. The duration of the intervals $t_{13}$–$t_{14}$ and $t_{15}$–$t_{16}$ are each 2 to 8% of the duration of the interval $t_{11}$–$t_{17}$, and is of a duration of 7 to 30 seconds.

The duration of the preliminary stage is 1 to 3 hours, the duration of the basic stage is 48 to 144 hours depending on the density of the normal current pulse. During the preparatory stage, there occur changes on the surfaces of the electrodes which contribute to the formation of a homogenous fine-grained initial structure during the initial stage, which is also facilitated by the reduced current density during this stage. The relatively low density of the reverse current, being sufficient for achieving the favourable effects of its passing through, contributes also to an additional increase in the current efficiency.

EXAMPLE

The invention is further illustrated by the following example:

Electric refining of lead with alternating current is conducted with a composition of the electrolyte as follows: $C_{H_2SiF_6}=80$ g/l, $C_{PbSiF_6}$ equivalent to $C_{Pb}=70$ g/l and gelatine additives 2000 g/Mg refined Pb, lignosulphonate 2500 g/Mg refined Pb. The temperature of the electrolyte is 315 degrees K and the linear velocity of its motion in the bath 1.5 m/min.

The anodes are cast of lead with a content of basic admixtures $C_{Sb}=1\%$, $C_{Ag}=0.2\%$, $C_{Cu}=0.02\%$, $C_{Bi}=0.3\%$, $C_{As}=0.03\%$. The cathode matrices are sheets of cast lead with a purity of 99.99% and thickness 0.8 to 1 mm, fastened by means of rods in the form of hollow copper pipes with a diameter of 25 mm outer and 20 mm inner. The initial distance between the electrodes (anode-anode) is 100 mm.

The duration of the preparatory stage of the process is 15 min, the width of the current pulses is 10 sec, and their density is 150 $A/m^2$.

The duration of the initial stage of the process is 2 hours, the density of the current pulse passing in normal direction being 150 $A/m^2$, and in the reverse direction being 75 to 80 $A/m^2$. The duration of one cycle is 22.6 sec, of which 20 sec are for the passing of normal current, $2\times1$ sec for passing of reverse current and $3\times0.2$ sec for pauses.

The basic stage is conducted with a density of the normal current at 300 $A/m^2$, and density of the reverse current at 150 to 160 $A/m^2$ with the same cycle as the initial cycle. The duration of the whole process is 72 hours.

As a result, there is produced lead with a purity of 99.99% at a relative power consumption 150 to 170 kWh/Mg and coefficient of current efficiency of 0.87 to 0.91.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. A method for electric refining of lead with alternating current having a period duration 7 to 30 sec, relative duration of reverse pulses being 2 to 8% of the duration of combined forward and reverse pulses and density of forward current pulses being 100 to 500 $A/m^2$, said method comprising the steps of dividing the process into three consecutive stages, a preparatory stage, an initial stage and a basic stage;

during the preparatory stage, subjecting the surfaces of electrodes to the action of current pulses of differing polarity with equal width and intensity for a period of 600 to 900 seconds with pulses having a width of 5 to 15 seconds;

during the initial stage, effecting an electric refining with alternating current with reduced current density for a period of 2 to 30 hours, the density of the forward current during the initial stage being half that necessary for the basic stage of the process, the density of the reverse current during the initial being 50% to 80% of that of the normal current during the initial stage;

during the basic stage, effecting an electric refining with alternating current with a density of the reverse current during the basic stage being 50% to 80% of that of the normal forward current during the basic stage.

2. A circuit for electric refining of lead with alternating current comprising two controllable current rectifiers connected in parallel and in the same direction with two respective semicontrollable thyristor switches;

each of the two current rectifiers being connected with a different respective group of baths for electric refining of lead;

both controllable current rectifiers being connected in series and in opposite direction to a first common point therebetween;

both groups of baths being connected in series and in opposite direction in between to a second common point therebetween;

between the second common point and the first common point there being connected a common semicontrollable thyristor switch in its conductive direction.

* * * * *

UNITED STATES PATENT AND TRADEMARK OFFICE

CERTIFICATE OF CORRECTION

PATENT NO. : 4,966,624

DATED : October 30, 1990

INVENTOR(S) : Ivan D. Enchev et al.

It is certified that error appears in the above-identified patent and that said Letters Patent is hereby corrected as shown below:

Cover page, column 1, immediately following item [22], insert item [30] as follows:

--Foreign Application Priority Data

September 6, 1988 Bulgaria 85374--.

Signed and Sealed this

Eighteenth Day of February, 1992

*Attest:*

HARRY F. MANBECK, JR.

*Attesting Officer*

*Commissioner of Patents and Trademarks*